US008417160B2

(12) United States Patent
Ishiguro et al.

(10) Patent No.: US 8,417,160 B2
(45) Date of Patent: Apr. 9, 2013

(54) TONER CARTRIDGE INCLUDING A TONER FLOWING-OUT PREVENTING VALVE

(75) Inventors: Yasuyuki Ishiguro, Osaka (JP); Koichi Mihara, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 321 days.

(21) Appl. No.: 12/878,278

(22) Filed: Sep. 9, 2010

(65) Prior Publication Data

US 2011/0064482 A1 Mar. 17, 2011

(30) Foreign Application Priority Data

Sep. 15, 2009 (JP) ..... 2009-213815

(51) Int. Cl.
*G03G 15/08* (2006.01)

(52) U.S. Cl. ..... 399/263

(58) Field of Classification Search ..... 399/263, 399/260, 262

See application file for complete search history.

(56) References Cited

FOREIGN PATENT DOCUMENTS

| | | | |
|---|---|---|---|
| JP | 2000-214667 A | | 8/2000 |
| JP | 2000-315007 A | | 11/2000 |
| JP | 2003-233247 A | | 8/2003 |
| JP | 2003280344 A | * | 10/2003 |
| JP | 2007-086311 A | | 4/2007 |

OTHER PUBLICATIONS

Computer translation of JP2003-280344A; Oct. 2003; to Komori et al.*

* cited by examiner

*Primary Examiner* — Quana M Grainger

(74) *Attorney, Agent, or Firm* — Renner, Otto, Boisselle & Sklar, LLP

(57) ABSTRACT

A toner cartridge includes a toner container for containing toner, a toner discharge section provided on one side part of the toner container and having a toner discharge port, an auger screw provided in the toner container, for conveying toner in the toner container to the toner discharge section, and a toner flowing-out preventing valve provided in a communicating part between the toner container and the toner discharge section to prevent flowing out of toner. The toner flowing-out preventing valve is configured to open and close the communicating part in conjunction with rotation of the auger screw.

4 Claims, 9 Drawing Sheets

TONER CARTRIDGE INCLUDING A TONER FLOWING-OUT PREVENTING VALVE

CROSS-REFERENCE TO RELATED APPLICATION

This application claims priority to Japanese Patent Application No. 2009-213815, which was filed on Sep. 15, 2009, the content of which is incorporated herein by reference in its entirety.

BACKGROUND OF THE INVENTION

1. Field of the Invention

The present invention relates to a toner cartridge for use in an image forming apparatus such as a laser beam printer or a multi-functional peripheral, particularly to a toner cartridge for containing toner disposed so as to be exchangeable such as a toner hopper and a toner bottle, and an image forming apparatus using the same.

2. Description of the Related Art

Conventionally, an image forming apparatus using electrophotography such as a copying apparatus, a facsimile apparatus, a printer or a multi functional peripheral having these functions, using a two-component developer is configured to perform a continuous operation of outputting an image by automatically supplying toner to a developing device by a toner supply apparatus using a toner cartridge or the like. Then, in toner shortage, a toner cartridge, a process cartridge, etc. can be easily replaced to supply toner.

Toner containers such as toner cartridges or process cartridges are, when stored in a warehouse or the like, sometimes stacked to face various directions without the stacking directions being controlled. For example, for toner cartridges of a type which discharges toner from one end side of a cartridge main body thereof, when stacked vertically so that a side of a toner discharge port face downward, toners inside the cartridges go down with their own weight as time elapses, therefore, toner density near the toner discharge port becomes high. As a result, toners may aggregate or become an agglomerate to clog the toner discharge port in a serious case.

In the case where the toner cartridge in the above-described state is newly mounted on the image forming apparatus, toner is hard to be discharged from the toner cartridge, and in the worst case, it is possible to be judged as being out of toner even though a large amount of the toner are left in the toner cartridge. Therefore, when newly mounting a toner cartridge, although such a countermeasure that the cartridge is shaken several times before mounting is performed, nevertheless such a problem occurs. Particularly, with a latest toner whose low temperature fixation property is improved for an energy saving measure, preservation stability is deteriorated, and therefore, in a state of being naturally left, there is a tendency that the toner aggregation easily occurs.

In a latest image forming apparatus, reducing the size thereof is required, and therefore, the sizes of a toner container and a developing device are reduced in association therewith, and thus a space of setting those is also made to be smaller. Accordingly, the condition where each of units is closely stuffed up causes a condition where the toner aggregation easily occurs. In mounting the toner cartridge has been stored in the warehouse on the image forming apparatus, even though the user or the like is requested to mount the toner cartridge after shaking it, the user or the like often forgets to do so, so that the toner may not be discharged as a result, and thus causing a trouble such as detection of shortage of toner concentration in a developer or stopping of an image forming apparatus itself. To counter with this problem, for example, Japanese Unexamined Patent Publication JP-A 2000-214667 discloses a developer supplying apparatus in which a part of a conveying spiral of a conveying auger provided in a toner cartridge is cut to reduce pressure of the toner.

However, even in the case of JP-A 2000-214667, there has been a problem that when fluidity of the toner is lost (to be put into a state of loose aggregation) as the toner cartridge has been left for a long time while a toner discharge port is faced downward, in a first toner supply operation after mounted in the image forming apparatus, that is, in rotation of the auger screw, a toner near the toner discharge port is not discharged to the outside of the toner cartridge and as a result, toner which had nowhere to go is fixed as compressed by the pressure of the auger screw, and thus the rotation of the auger screw is locked.

SUMMARY OF THE INVENTION

An object of the invention is to provide a toner cartridge capable of preventing agglomeration of toner at a toner discharge port and preventing such a defect that rotation of an auger screw is locked, and an image forming apparatus using the same.

The invention provides a toner cartridge comprising:

a container for containing toner, having an opening for discharging the contained toner;

a toner discharge section provided through a communicating part at a side part of the container where the opening is provided, having a discharge port for discharging toner;

an auger screw provided with a rotation shaft and a spiral blade and rotatably supported in the container, for conveying toner in the container from the opening to the toner discharge section; and a toner flowing-out preventing valve provided in the communicating part, for preventing flowing out of the toner from the opening to the toner discharge section, the toner flowing-out preventing valve being configured so as to open and close the communicating part in conjunction with rotation of the auger screw.

According to the invention, by action of the spiral blade accompanying rotation of the rotation shaft of the auger screw provided in the container, toner contained in the toner container is conveyed to the toner discharge section. Then, by providing the toner flowing-out preventing valve in the communicating part between the container and the toner discharge section, a toner flowing into the toner discharge section having the toner discharge port is able to be controlled. As a result, in shipping the toner cartridges, locking phenomenon of the auger screw which occurs by the toner compressed by the pressure of the auger screw to be fixed is able to be prevented by preventing the toner from entering into the toner discharge section from the toner container. Moreover, an unexpected flowing out of the toner which is triggered by vibrations or the like when the auger screw is stopped is able to be prevented. Further, phenomenon of toner flowing out (toner avalanche) that occurs by vibrations or the like when the auger screw is stopped after rotation operation is able to be prevented by preventing the toner from entering into the toner discharge section from the toner container when the auger screw is stopped after rotation operation. In addition, since closing operation of the toner flowing-out preventing valve is able to be performed by rotation operation of the auger screw, a special driving mechanism is not necessary, and thus it is easy to miniaturize the toner cartridge.

Further, in the invention, it is preferable that the toner flowing-out preventing valve has a fixation shielding plate fixed to an inner wall of the toner discharge section and having an opening, and a rotation shielding plate fixed to the rotation shaft of the auger screw and opening and closing the opening, the fixation shielding plate is arranged to be in non-contact with the rotation shaft and the rotation shielding plate and to be along a surface vertical to an axial line of the rotation shaft of the auger screw, and the rotation shielding plate is arranged to be in non-contact with an inner wall of the toner discharge section and the shielding plate and to be along the surface vertical to the rotation shaft.

According to the invention, since there is no contact point in the toner flowing-out preventing valve, it is possible to prevent the toner from aggregating to be fused by frictional heat. Furthermore, the fixation shielding plate is fixed to the inner wall of the toner discharge section and the rotation shielding plate is fixed to the rotation shaft of the auger screw, therefore a special mechanism to open and close the communicating part in conjunction with rotation of the auger screw is not necessary.

Further, in the invention, it is preferable that the fixation shielding plate has a plurality of sectorial openings and the rotation shielding plate has a plurality of sectorial shielding pieces which coincide with the opening.

According to the invention, when the opening of the toner flowing-out preventing valve is closed, the rotation shielding plate moves toward a direction for shearing the toner, thereby the toner being in loose aggregation is able to be disintegrated.

Further, in the invention, it is preferable that at least one of the fixation shielding plate and the rotation shielding plate is made of a material having flexibility.

According to the invention, even when the toner gets stuck between the fixation shielding plate and the rotation shielding plate, since at least one of the fixation shielding plate and the rotation shielding plate is made of a material having flexibility, excessive stress is hard to be put on the toner, therefore aggregation of the toner is able to be prevented further effectively.

Further, the invention provides an image forming apparatus comprising:

a photoreceptor drum on which an electrostatic latent image is to be formed;

a developing device for developing a toner image by supplying toner to the electrostatic latent image formed on the surface of the photoreceptor drum;

the toner cartridge mentioned above, for supplying toner to the developing device;

a transfer device for transferring on a recording medium the toner image developed on the surface of the photoreceptor drum; and a fixing device for fixing the transferred toner image on the recording medium.

According to the invention, image formation is achieved by a series of processing of electrophotography comprising forming an electrostatic latent image on the surface of the photoreceptor drum, forming a toner image by developing the electrostatic latent image by the developing device, transferring the toner image on the recording medium by the transfer device and then fixing it thereon by the fixing device. In the process of the image formation, the auger screw in the toner cartridge is activated as needed so that supplying of toner from the toner cartridge to the developing device is achieved. Then, when rotation of the auger screw is stopped, the auger screw is stopped at a position where the toner flowing-out preventing valve blocks the opening, and thereby the locking phenomenon or the like of the auger screw is able to be prevented, therefore the toner concentration is able to be controlled stably so as to obtain the stable image concentration over a long term.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
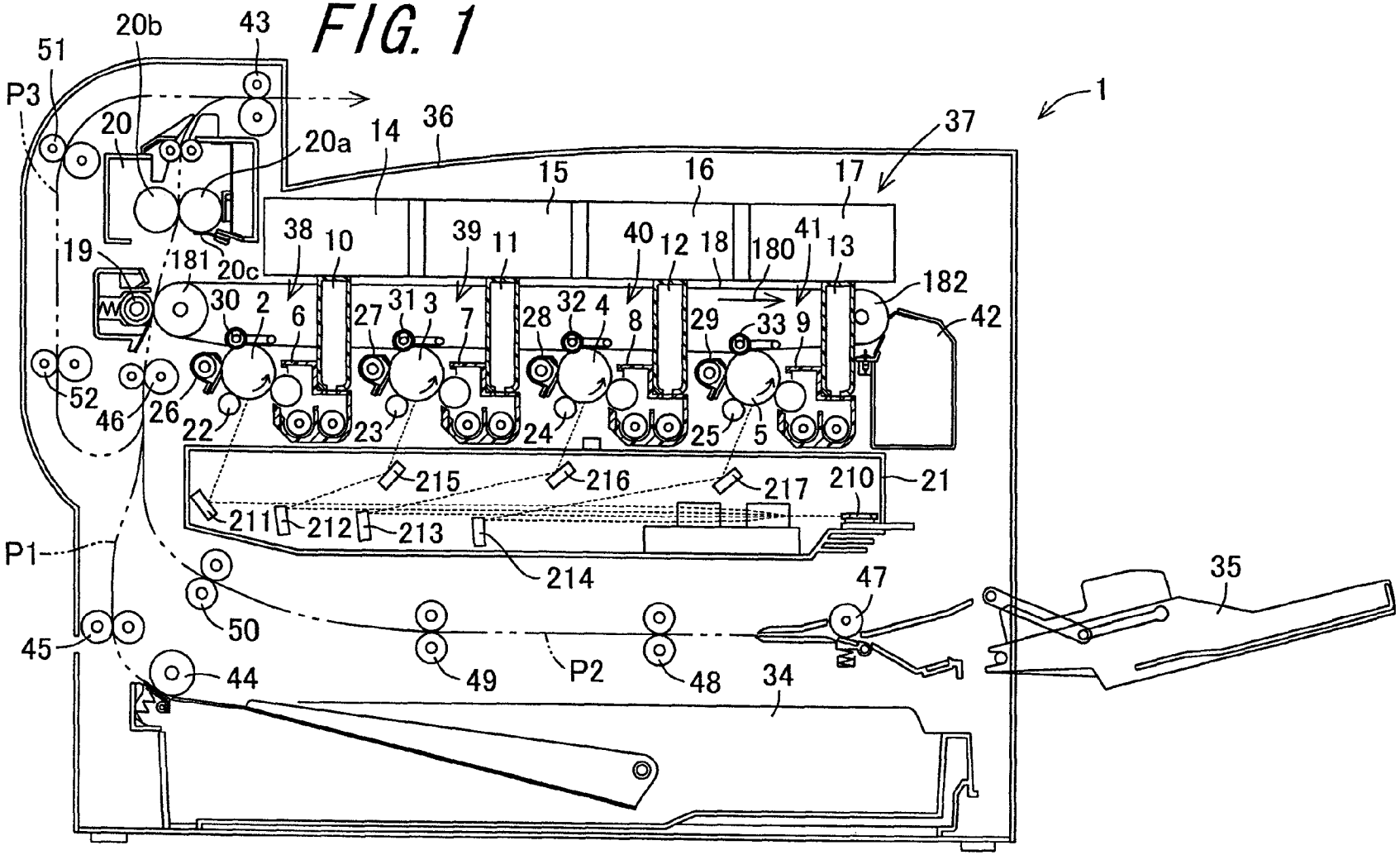
FIG. 1 is a schematic view showing an entire configuration of an image forming apparatus according to an embodiment of the invention.

Hereinafter, description will be given for preferred embodiments of the invention with reference to the drawings. FIG. 1 is a schematic view showing an entire configuration of an image forming apparatus 1 according to an embodiment of the invention. The image forming apparatus 1 according to the embodiment includes, as shown in FIG. 1, photoreceptor drums 2, 3, 4 and 5 on which electrostatic latent images are to be formed, developing devices 6, 7, 8 and 9 which form toner images by supplying toners to the electrostatic latent images on the surfaces of the photoreceptor drums 2, 3, 4 and 5, toner cartridges 14, 15, 16 and 17 which supply toners to the developing devices 6, 7, 8 and 9 through toner supply pipes 10, 11, 12 and 13 as toner supply members, a secondary transfer roller 19 as a transfer device configured to transfer the toner images on the surfaces of the photoreceptor drums 2, 3, 4 and 5 to a paper sheet with an intermediate transfer belt 18 interposed therebetween, and a fixing device 20 configured to fix the toner images on the paper sheet, and forms an image with using toner by electrophotography. Then, it is preferable that the toner cartridges 14, 15, 16 and 17 for use in the image forming apparatus 1 are provided with unique configurations which will be described below.

The image forming apparatus 1 according to the embodiment forms as a visible image a multi-color image on a predetermined sheet (recording paper) as a recording medium based on image data included in an input command such as image data transmitted from outside through a communication network or the like. The image forming apparatus 1 includes, as shown in FIG. 1, an exposure unit 21, photoreceptor drums 2, 3, 4 and 5 corresponding to image bearing members on which latent images are to be formed by the exposure unit 21, developing devices 6, 7, 8 and 9, charging rollers 22, 23, 24 and 25, cleaning units 26, 27, 28 and 29, the intermediate transfer belt 18, primary transfer rollers 30, 31, 32 and 33, the secondary transfer roller 19, the fixing device 20, paper conveyance paths P1, P2, P3, a paper feeding cassette 34, a manual paper feeding tray 35, a paper discharge tray 36, a toner cartridge unit 37 and the like.

As the image data of a color image which the image forming apparatus 1 deals with, the image data corresponding to each color of four colors including black (K), cyan (C), magenta (M), and yellow (Y) is used to perform formation of visible images in image forming sections 38, 39, 40 and 41. The image forming sections 38, 39, 40 and 41 correspond to color images using each of the colors. Accordingly, the charging rollers 22, 23, 24 and 25, the photoreceptor drums 2, 3, 4 and 5 and developing devices 6, 7, 8 and 9 are provided by four pieces respectively so that four kinds of latent images and toner images corresponding to each color are formed, and the cleaning units 26, 27, 28 and 29 and the primary transfer rollers 30, 31, 32 and 33 are also provided by four pieces corresponding thereto respectively. Each of the image forming sections 38, 39, 40 and 41 is configured similarly, and for example, the image forming section 38 of the black is configured by the photoreceptor drum 2, the developing device 6, the charging roller 22, the transfer roller 30 and the cleaning unit 26, etc.

The image forming sections 38, 39, 40 and 41 are arrayed in a line in a moving direction (sub-scanning direction) of the intermediate transfer belt 18. Note that, the image forming section 38 corresponds to black, the image forming section 39 corresponds to cyan, the image forming section 40 corresponds to magenta, and the image forming section 41 corresponds to yellow, and four image stations are configured by the above-described each section distinguished by each of these numeral references.

The exposure unit 21 which is the exposure device of the embodiment includes a semiconductor laser (not shown) as a laser light source, a polygonal mirror 210, first reflection mirrors 211, 212, 213 and 214, and second reflection mirrors 215, 216 and 217 etc., and with the image data of each color of black, cyan, magenta and yellow, each light beam of modulated laser beam or the like is irradiated to each of the photoreceptor drums 2, 3, 4 and 5. To each of the photoreceptor drums 2, 3, 4 and 5, an electrostatic latent image by the image data of each color of black, cyan, magenta and yellow is formed.

In the embodiment, although the exposure unit 21 is one with a technique using a laser scanning unit (LSU) including a laser irradiation section and a reflection mirror, one with a technique in which light emitting elements are arranged in an array using EL or LED write head, for example, may be used.

The photoreceptor drums 2, 3, 4 and 5 are arranged above the exposure unit 21, are image bearing members each having a substantially cylinder shape, and are controlled to rotate in a predetermined direction (refer to an arrow attached to each of the photoreceptor drums 2, 3, 4 and 5) by a driving section and a control section which are not shown. The photoreceptor drums 2, 3, 4 and 5 are so configured that a photoconductive layer is formed on a conductive substrate. For example, a metal drum made of aluminum or the like is the substrate, and on the outer circumferential surface thereof, the photoconductive layer of amorphous silicon (a-Si), selenium (Se), or organic photo-semiconductor (OPC) etc., is formed as a thin film. Note that, the configuration of the photoreceptor drums 2, 3, 4 and 5 is not particularly limited to the above-described configuration. The charging rollers 22, 23, 24 and 25 are chargers of a contact type which charge the surfaces of the photoreceptor drums 2, 3, 4 and 5 uniformly to predetermined potential. In the embodiment, as shown in FIG. 1, although charging rollers 22, 23, 24 and 25 of a roller type and the contact type are used as the chargers, in replacement of such charging rollers 22, 23, 24 and 25, chargers of a charge type or a brush type may be used.

The developing devices 6, 7, 8 and 9 supply toner to the surfaces of the photoreceptor drums 2, 3, 4 and 5 on which the electrostatic latent images are formed, to develop the electrostatic latent images to the toner images. Each of the developing devices 6, 7, 8 and 9 contains toner of each of the colors of black, cyan, magenta, and yellow, and visualize the electrostatic latent image corresponding to each of the colors formed on each of the surfaces of the photoreceptor drums 2, 3, 4 and 5 into the toner image of each of the colors of black, cyan, magenta and yellow. The cleaning units 26, 27, 28 and 29 remove and collect residual toners on the surfaces of the photoreceptor drums 2, 3, 4 and 5 with a lubricant or the like after development and image transfer.

The intermediate transfer belt 18 arranged above the respective photoreceptor drums 2, 3, 4 and 5 is supported around a driving roller 181 and a driven roller 182 with tension, and forms a loop-shaped moving path. The photoreceptor drum 5 (yellow), the photoreceptor drum 4 (magenta), the photoreceptor drum 3 (cyan) and the photoreceptor drum 2 (black) are arranged in this order to face the outer circumferential surface of the intermediate transfer belt 18 along with a moving direction 180 thereof. The primary transfer rollers 30, 31, 32 and 33 are arranged at positions facing the respective photoreceptor drums 2, 3, 4 and 5 with the intermediate transfer belt 18 interposed therebetween. The respective positions at which the intermediate transfer belt 18 faces the photoreceptor drums 2, 3, 4 and 5 are primary transfer positions. The intermediate transfer belt 18 is a film having a thickness of about 100 to 150 μm, and formed to be an endless-shape. A primary transfer bias having opposite polarity to charging polarity of the toner is applied by constant voltage control to the primary transfer rollers 30, 31, 32 and 33 in order to transfer the toner images borne on the surfaces of the photoreceptor drums 2, 3, 4 and 5 onto the intermediate transfer belt 18. Thereby, the toner images of the respective colors formed on the photoreceptor drums 2, 3, 4 and 5 are overlapped and transferred onto the outer circumferential surface of the intermediate transfer belt 18 sequentially, and a full-color toner image is formed on the outer circumferential surface of the intermediate transfer belt 18.

However, when image data for only a part of the colors of yellow, magenta, cyan and black is inputted, electrostatic latent images and toner images are formed at only a part of the photoreceptor drums corresponding to the color of the input image data among the four photoreceptor drums 2, 3, 4 and 5. For example, during monochrome image formation, formation of an electrostatic latent image and formation of a toner image are performed only at the photoreceptor drum 2 corresponding to the color of black, and only a black toner image is transferred onto the outer circumferential surface of the intermediate transfer belt 18.

Each of the primary transfer rollers 30, 31, 32 and 33 is configured by coating a surface of a shaft whose raw material is metal having a diameter of 8 to 10 mm (stainless steel, for example) with a conductive elastic material (such as EPDM, urethane foam, etc.), and applies high voltage uniformly to the intermediate transfer belt 18 by the conductive elastic material. In the embodiment, although the primary transfer rollers 30, 31, 32 and 33 are used as transfer electrodes, other than them, a brush or the like is also usable. The toner image transferred onto the outer circumferential surface of the intermediate transfer belt 18 at each primary transfer position is conveyed to a secondary transfer position, which is a position facing the secondary transfer roller 19, by the rotation of the intermediate transfer belt 18 along the moving direction 180. The secondary transfer roller 19 is in pressure-contact, at a predetermined nip pressure, with the outer circumferential surface of the intermediate transfer belt 18 whose inner circumferential surface is in contact with a circumferential surface of a driving roller 181 during image formation. To obtain the nip pressure constantly, either of the secondary transfer roller 19 or the intermediate transfer belt driving roller 181 is formed by a hard material such as metal, and another one is formed by a soft material such as an elastic roller or the like (elastic rubber roller, foamable resin roller, etc.).

When a paper sheet fed from a paper feeding cassette 34 or a manual paper feeding tray 35 passes through between the secondary transfer roller 19 and the intermediate transfer belt 18, high voltage with opposite polarity (+) to the charging polarity of the toner (−) is applied to the secondary transfer roller 19. As described above, the electrostatic latent images formed on the surfaces of respective photoreceptor drums 2, 3, 4 and 5 are visualized by the toner corresponding to each of the colors to form respective toner images, and such toner images are layered on the intermediate transfer belt 18. Thereafter, the layered toner images are moved to a contact position of the conveyed paper sheet with the intermediate transfer belt 18 by the rotation movement of the intermediate transfer belt 18, and by the secondary transfer roller 19 arranged in this position, the toner images are transferred from the outer circumferential surface of the intermediate transfer belt 18 onto the paper sheet.

Toners adhered to the intermediate transfer belt 18 by the contact of the intermediate transfer belt 18 with the photoreceptor drums 2, 3, 4 and 5, and toners remaining on the intermediate transfer belt 18 without being transferred in transferring the toner image from the intermediate transfer belt 18 to the paper sheet become a source of causing color mixture of the toner at the next step, therefore removal and collection thereof are performed by an intermediate transfer belt cleaning unit 42. The intermediate transfer belt cleaning unit 42 is provided with, for example, a cleaning blade as a cleaning member that is in contact with the intermediate transfer belt 18. A part of the intermediate transfer belt 18 where the cleaning blade is in contact therewith is supported by an intermediate transfer belt driven roller 182 from a backside thereof.

The paper sheet to which a toner image is transferred as a visible image is guided by the fixing device 20 comprised of a heating roller 20*a* and a pressure roller 20*b*, passes through between the heating roller 20*a* and the pressurizing roller 20*b*, and subjected to the processing of heating and pressurizing. Thereby, the toner image to be the visible image is fixed firmly on the surface of the paper sheet. The paper sheet on which the toner image has been fixed is discharged by paper discharge rollers 43 onto the paper discharge tray 36. On the heating roller 20*a*, a temperature sensor (such as thermistor, for example) 20*c* is provided, and based on surface temperature detection information of the heating roller 20*a* by the temperature sensor, heat generation control in a heat generating section of the heating roller 20*a* is performed by a control section (not shown).

The image forming apparatus 1 is provided with a paper conveyance path P1 of a substantially vertical direction so that the paper sheet contained in the paper feeding cassette 34 is fed, through between the secondary transfer roller 19 and the intermediate transfer belt 18 and through the fixing device 20, to the paper discharge tray 36. Arranged in the paper conveyance path P1 are a pick-up roller 44 for feeding the paper in the paper feeding cassette 34 into the paper conveyance path P1 sheet by sheet, conveying rollers 45 for conveying the fed paper sheet upward, registration rollers 46 for guiding the conveyed paper sheet between the secondary transfer roller 19 and the intermediate transfer belt 18 at a predetermined timing, and the paper discharge rollers 43 for discharging the paper sheet to the paper discharge tray 36. In addition, inside the image forming apparatus 1, a paper conveyance path P2 on which a pick-up roller 47 and conveyance rollers 48, 49 and 50 are arranged is formed between the manual paper feeding tray 35 and the registration rollers 46. Further, a paper conveyance path P3 is formed from the paper discharge rollers 43 to an upstream side of the registration rollers 46 in the paper conveyance path P1.

The paper discharge rollers 43 are rotatable in both forward and reverse directions, and are driven in the forward direction to discharge a paper sheet to the paper discharge tray 36 during single-sided image formation in which an image is formed on one side of the paper sheet, and during second side image formation of double-sided image formation in which an image is formed on both sides of the paper sheet. On the other hand, during first side image formation of the double-sided image formation, the paper discharge rollers 43 are driven in the forward direction until a tail end of the paper sheet passes through the fixing device 20, and are then driven in the reverse direction to guide the paper sheet in the paper conveyance path P3 in a state where the tail end of the paper sheet is held. In the paper conveyance path P3, a reverse conveyance rollers 51 and 52 are arranged and with these reverse conveyance rollers 51 and 52, the paper sheet on which an image has been formed only on one side during double-sided image formation is guided from the paper conveyance path P3 to the paper conveyance path P1 in a state where the paper is turned over and upside down.

The paper sheet that has been fed from the paper feeding cassette 34 or the manual paper feeding tray 35 and has been conveyed through the paper conveyance path P3 is guided by the registration rollers 46 between the secondary transfer roller 19 and the intermediate transfer belt 18 in synchronization with the rotation of the intermediate transfer belt 18. Thus, the rotation of the registration roller 46 is stopped when the operation of the photoreceptor drums 2, 3, 4 and 5 or the intermediate transfer belt 18 is started, and the movement of the paper sheet that has been fed or conveyed prior to rotation of the intermediate transfer belt 18 is stopped in the paper conveyance path P1 in a state where a leading end thereof abuts against the registration roller 46. Then, rotation of the registration roller 46 is started at timing when the leading end of the paper sheet faces a leading end of a toner image formed on the intermediate transfer belt 18 at a position where the secondary transfer roller 19 is in pressure-contact with the intermediate transfer belt 18.

Note that, during full-color image formation in which image formation is performed by all of the image forming sections 38, 39, 40, and 41, the primary transfer rollers 30, 31, 32 and 33 cause the intermediate transfer belt 18 to be in pressure-contact with all of the photoreceptor drums 2, 3, 4 and 5. On the other hand, during monochrome image formation in which image formation is performed only by the image forming section 38, only the primary transfer roller 30 causes the intermediate transfer belt 18 to be in pressure-contact with the photoreceptor drum 2.

Figure 2:
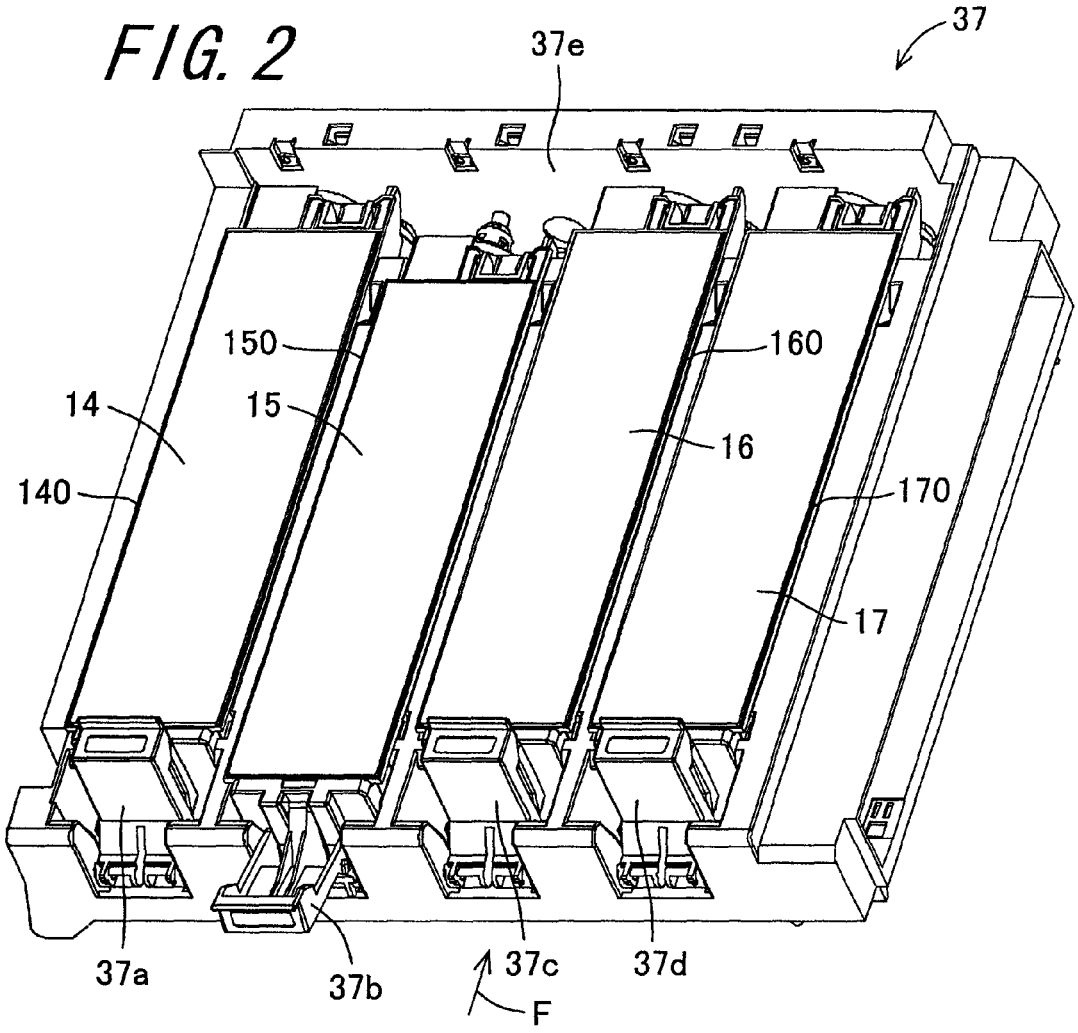
FIG. 2 is a perspective view showing the configuration of a toner cartridge unit.

Next, description will be given in detail for the configuration of the characteristic toner cartridges 14, 15, 16 and 17 according to the embodiment with reference to the drawings. FIG. 2 is a perspective view showing the configuration of a toner cartridge unit 37 in which four pieces of the toner cartridges 14, 15, 16 and 17 are unitized in block. As the toner cartridges 14, 15, 16 and 17, as shown in FIG. 2, four pieces of the toner cartridges 14, 15, 16 and 17 are mounted side by side on the toner cartridge unit 37. When any of lock levers 37*a*, 37*b*, 37*c* and 37*d* provided on the toner cartridge unit 37 corresponding to respective toner cartridges 14, 15, 16 and 17 is raised up, any of toner containers 140, 150, 160 and 170 as toner containers is moved toward an arrow F direction so as to be held in a state of being pressed to a stopper plate 37*e*. In this manner, the toner cartridge unit 37 on which four pieces of the toner cartridges 14, 15, 16 and 17 are mounted side by side is set on the intermediate transfer belt 18. In the set state, it is configured that respective toner containers 140 to 170 and the toner supply pipes 10, 11, 12 and 13 are connected so that corresponding toners are able to be supplied to the developing devices 6, 7, 8 and 9 through toner supply pipes 10, 11, 12 and 13. Note that, FIG. 2 shows a state prior to attachment of a toner cartridge for cyan 15.

Figure 3A:
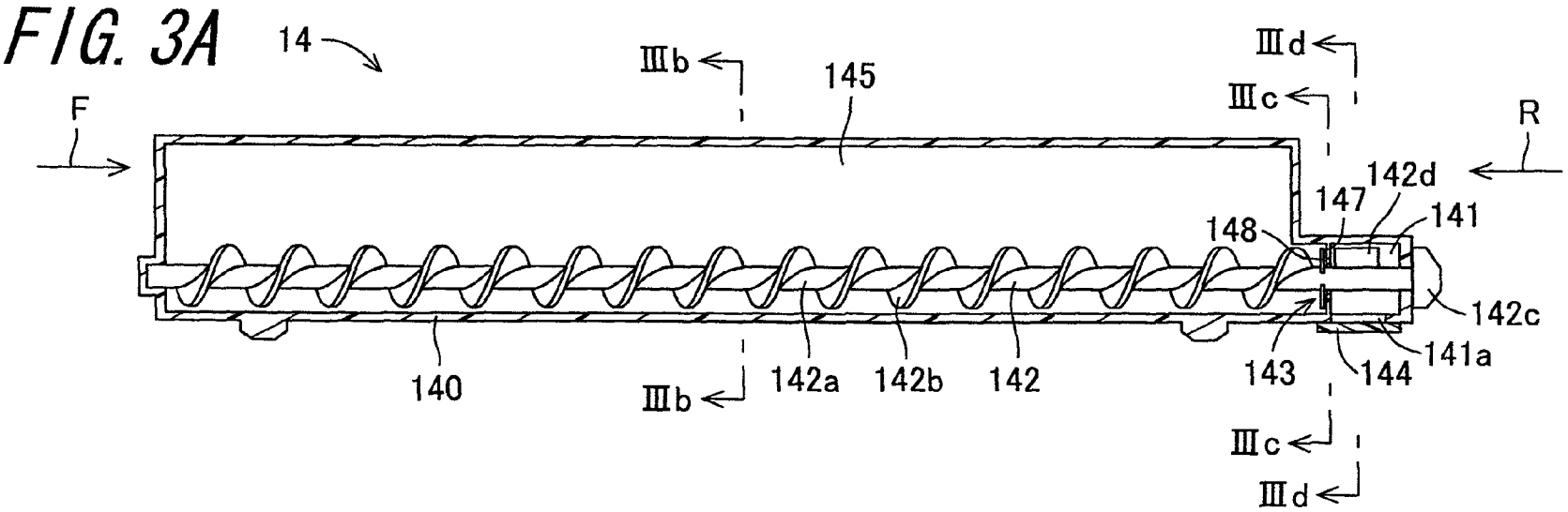
FIGS. 3A to 3D are sectional views showing the configuration of a toner cartridge.
Figure 3B:
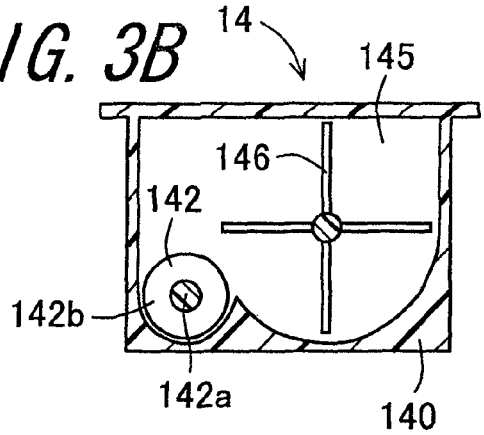
Figure 3C:
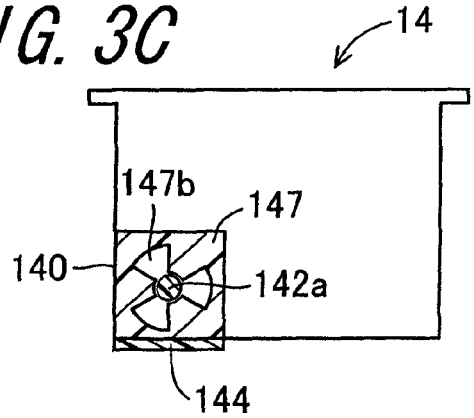
Figure 3D:
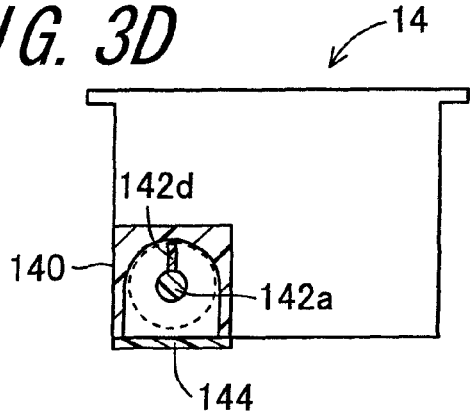
Figure 4:
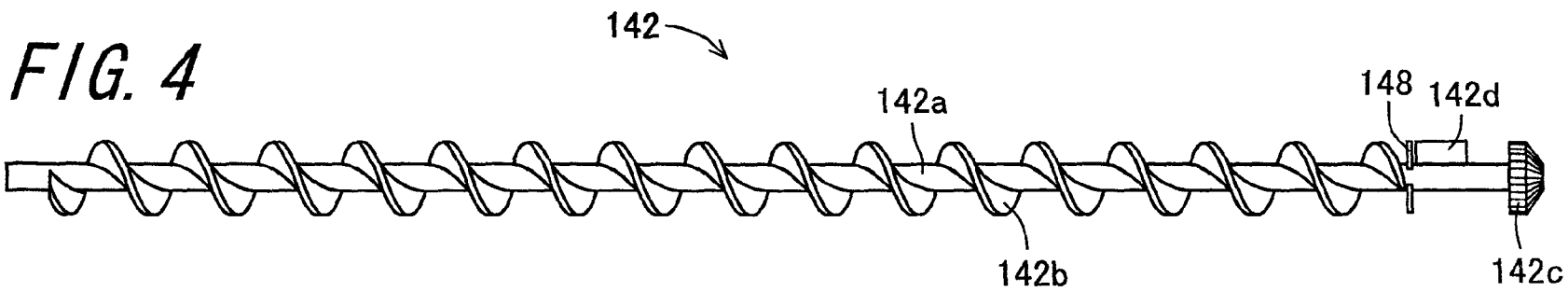
FIG. 4 is an external view of an auger screw and a rotation shielding plate constituting a toner flowing-out preventing valve.
Figure 5A:
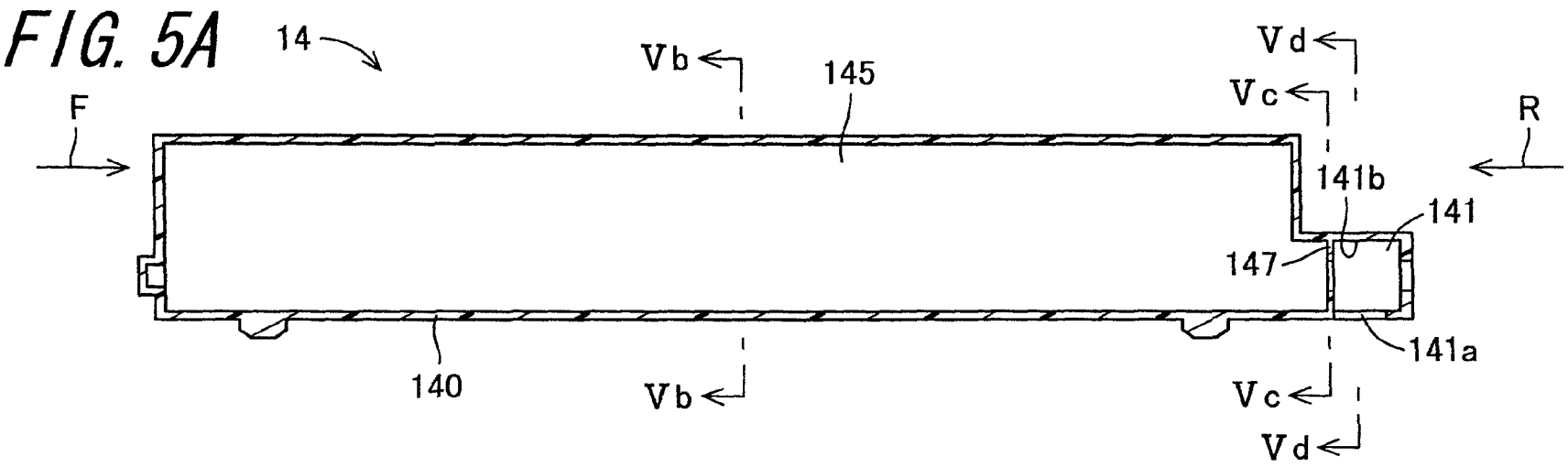
FIGS. 5A to 5D are sectional views of a toner container.
Figure 5B:
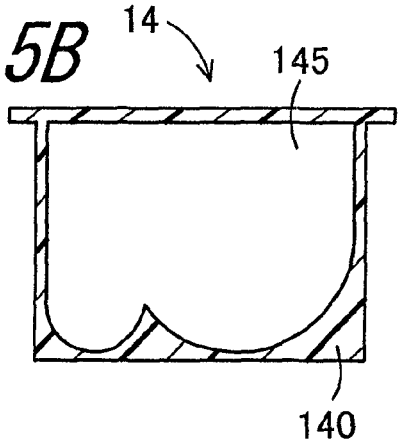
Figure 5C:
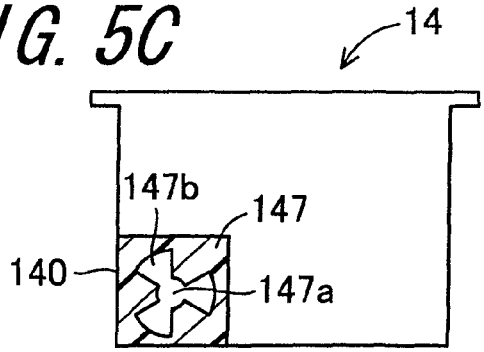
Figure 5D:
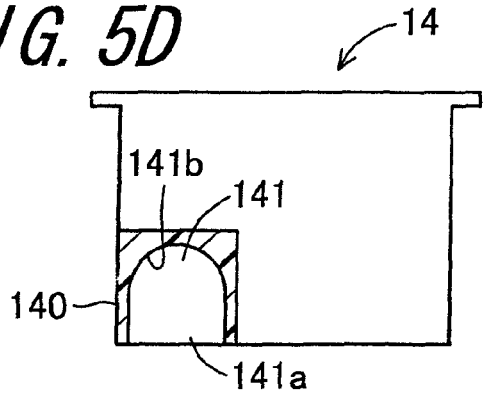
Figure 6A:
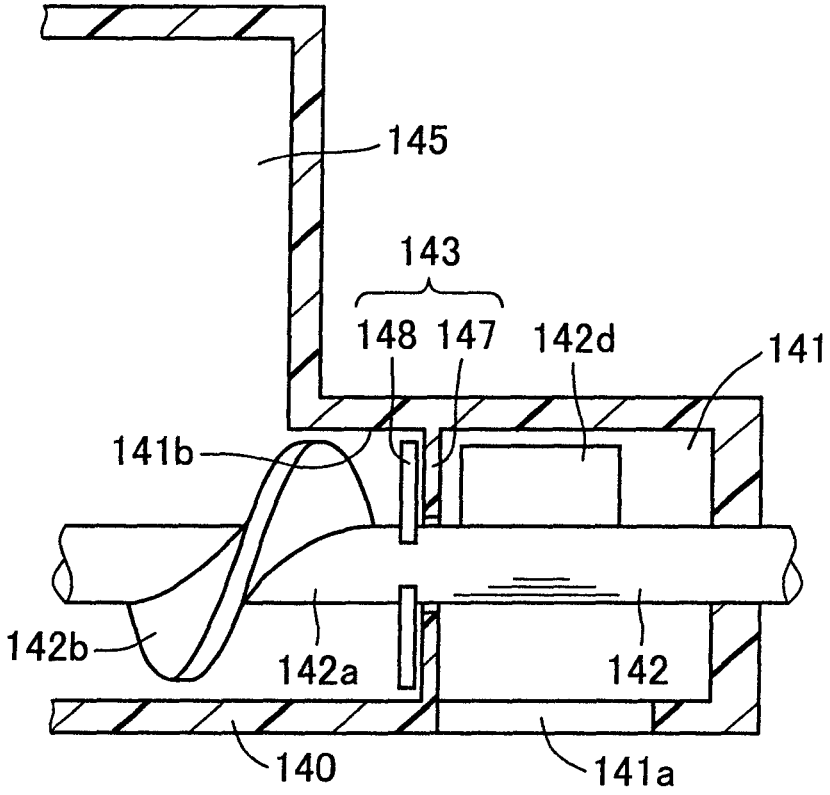
FIGS. 6A to 6C are enlarged views in the vicinity of the toner flowing-out preventing valve in FIG. 3A.
Figure 6B:
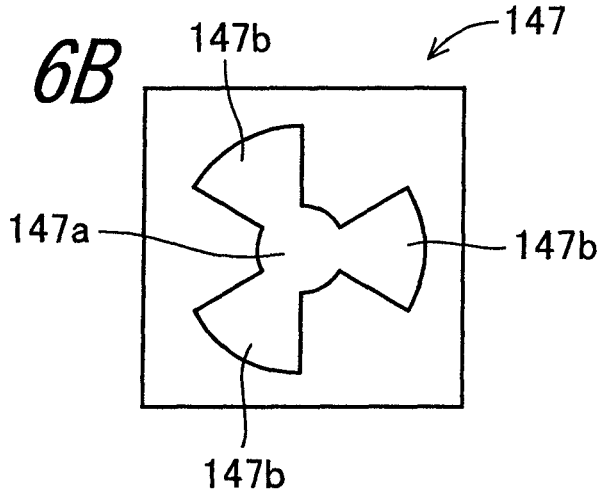
Figure 6C:
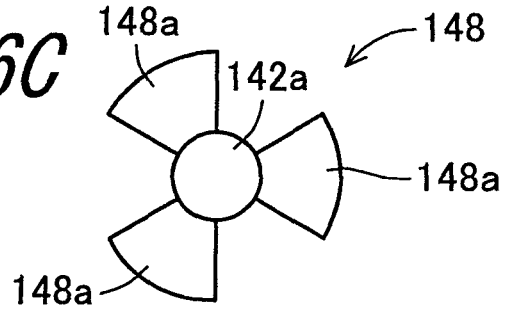

Next, description will be given in detail for the configuration of the toner cartridges 14, 15, 16 and 17 taking an example of the toner cartridge for black 14 with reference to FIGS. 3A to 3D, FIG. 4, FIGS. 5A to 5D and FIGS. 6A to 6C. Since other toner cartridges 15, 16 and 17 are configured similarly, description thereof will be omitted below. FIGS. 3A to 3D are sectional views showing the configuration of the toner cartridge 14. FIG. 3A shows a side sectional view prior to attachment of the toner cartridge 14 to the image forming apparatus 1, and FIG. 3B shows a sectional view taken along a sectional line IIIb-IIIb of FIG. 3A, and FIG. 3C shows a sectional view taken along a sectional line IIIc-IIIc of the same, and FIG. 3D shows a sectional view taken along a sectional line IIId-IIId of the same. FIG. 4 is an external view of an auger screw 142 and a rotation shielding plate 148 constituting the toner flowing-out preventing valve 143. FIGS. 5A to 5D are sectional views of the toner container 140. FIG. 5A shows a side sectional view of the toner container 140, FIG. 5B shows a sectional view taken along a sectional line Vb-Vb of FIG. 5A, FIG. 5C shows a sectional view taken along a sectional line Vc-Vc of the same, and FIG. 5D shows a sectional view taken along a sectional line Vd-Vd of the same. FIGS. 6A to 6C are enlarged views in the vicinity of the toner flowing-out preventing valve in FIG. 3A. FIG. 6A shows an enlarged sectional view, FIG. 6B shows a front view of the fixation shielding plate constituting the toner flowing-out preventing valve, and FIG. 6C shows a front view of the rotation shielding plate constituting the toner flowing-out preventing valve.

As shown in FIGS. 3A to 3C, the toner cartridge 14 includes the toner container 140 which contains a black toner, a toner discharge section 141, the auger screw 142 and the toner flowing-out preventing member 143. The toner discharge section 141 is provided on one side part of the toner container 140 and has a toner discharge port 141*a*. The auger screw 142 includes a rotation shaft 142*a* and a spiral blade 142*b* and is provided in the toner container 140 and conveys a toner in the toner container 140 to the toner discharge section 141. The toner flowing-out preventing member 143 is provided in a communicating part between the toner container 140 and the toner discharge section 141 and prevents flowing out of the toner. The toner discharge port 141*a* is provided with a shutter 144. Furthermore, in a toner containing space 145 of the toner container 140, a stirring paddle 146 which is parallel to the auger screw 142 is rotatably supported.

The toner container 140 includes the toner discharge section 141 at one end thereof, and is a toner container of a substantially square column containing a black toner, and inside thereof, and rotatably supports the auger screw 142 and the stirring paddle 146 in the toner containing space 145. When attaching the toner container 140 to the toner cartridge unit 37 by moving the toner container 140 in the arrow F direction, the toner cartridge 14 is moved in a substantially horizontal direction to the toner supply pipe 10 (refer to FIG. 1), and thereby the shutter 144 relatively moves in an opposite direction to the arrow F direction substantially horizontally against resilience of a spring of which illustration is omitted, so that the toner discharge port 141*a* is opened when arranged at a position facing the toner supply pipe 10. Thereby the black toner is in a state of being able to be supplied into the toner container 140 from an upper surface of the toner supply pipe 10.

The auger screw 142 includes a rotation shaft 142*a*, a spiral blade 142*b*, and a driving gear 142*c*, and rotation thereof conveys the black toner inside the toner container 140 toward the toner discharge port 141*a*. One piece of a paddle piece 142*d* is formed on the rotation shaft 142*a* positioned at the toner discharge port 141*a*, and functions to push out to the toner discharge port 141*a* the black toner conveyed to the toner discharge section 141 without being stacked up therearound along with the rotation of the rotation shaft 142*a*. The stirring paddle 146 is a stirring member that has four pieces of stirring blades around the rotation shaft and functions to disintegrate the black toner in the toner container 140 by the rotation. The toner discharge port 141*a* is a rectangular opening provided on a bottom part of the toner discharge section 141 of the toner container 140, and discharges the black toner conveyed by the auger screw 142 to the outside of the toner cartridge 14. The shutter 144 is a shutter member formed in a rectangular plate shape slidably provided to a position of closing the toner discharge port 141*a*, and it is configured that when the toner cartridge 14 is attached to the image forming apparatus 1, receiving action of an action piece (not shown) provided on the image forming apparatus 1, slidingly moves against resilience of the spring so as to open the toner discharge port 141*a*. By opening thereof, the black toner contained in the toner container 140 is supplied to the developing device 6 through the toner supply pipe 10.

As shown in FIG. 6A, the toner flowing-out preventing valve 143 is comprised of a fixation shielding plate 147 fixed to an inner wall 141*b* of the toner container 140 forming the toner discharge section 141, and a rotation shielding plate 148 fixed to the rotation shaft 142*a* of the auger screw 142, arranged at a position that divides the inside of the toner container 140 into the toner discharge section 141 and the toner containing space 145, and functions as a valve for opening and closing the communicating part between the toner containing space 145 and the toner discharge section 141. With this valve, flowing out of the black toner from the toner containing space 145 side to the toner discharge section 141 side is controlled.

The fixation shielding plate 147 is, as shown in FIG. 5C and FIG. 6B, a flexible plate-like member having a circular hole 147*a* in which the rotation shaft 142*a* of the auger screw 142 is able to be inserted in non-contact therewith and three pieces of sectorial openings 147*b* which are formed radially around the circular hole 147*a* at equal intervals and at equal angular intervals. The rotation shielding plate 148 is, as shown in FIG. 6C, fixed to the rotation shaft 142*a* of the auger screw 142 and comprised of three pieces of sectorial shielding pieces 148*a* which are formed on a surface vertical to the axial line of the rotation shaft 142*a* of the auger screw 142. Each of the sectorial shielding pieces 148*a* is configured to coincide with each of the sectorial openings 147*b* of the fixation shielding plate 147. The fixation shielding plate 147 and the rotation shielding plate 148 are arranged in a position relation of being adjacent in the axial direction and in non-contact with each other.

By such configuration, when the sectorial shielding pieces 148*a* coincide with the sectorial openings 147*b* along with rotation of the rotation shaft 142*a* of the auger screw 142 around the axial line, the sectorial openings 147*b* are shielded so that the conveyance of the black toner from the inside of the toner containing space 145 to the toner discharge section 141 is inhibited. Furthermore, when the sectorial shielding pieces 148*a* are at a position of not coinciding with the sectorial openings 147*b*, the black toner is conveyed to the toner discharge section 141 through the sectorial openings 147*b*. Accordingly, opening and closing operation of the toner flowing-out preventing valve 143 is able to be performed with only the rotation operation of the auger screw 142, and thereby a special driving mechanism is not necessary, and it is easy to miniaturize the toner cartridge 14.

Then, when the opening of the toner flowing-out preventing valve 143 (sectorial openings 147*b* of the fixation shielding plate 147) is closed, the rotation shielding plate 148 moves toward a direction in which the black toner is sheared, and thus the black toner being in loose aggregation is able to be disintegrated. Further, even when the toner gets stuck between the fixation shielding plate 147 and the rotation shielding plate 148, since the fixation shielding plate 147 is made of a flexible material, excessive stress is hard to be put on the black toner, therefore aggregation of the toner is able to be prevented. In this case, even when, in replacement of the fixation shielding plate 147, the rotation shielding plate 148 is made of the flexible material, or both of which are made of the flexible material, similar effects are able to be obtained. Here, as the flexible material, rubber or an elastic resin is used, and such material is formed to be a plate-like member by molding.

By the above-described configuration, closing operation of the toner flowing-out preventing valve 143 is able to be performed by the rotation operation of the auger screw 142, a special driving mechanism is not necessary, and it is easy to miniaturize the toner cartridge 14. In shipping the toner cartridges 14 or when the auger screw 142 is stopped after rotation operation, the phenomenon of toner flowing out (toner avalanche) that occurs by vibrations or the like immediately after attaching the toner cartridge 14 to the image forming apparatus 1 or when the auger screw 142 is stopped after rotation operation is able to be prevented by closing the toner discharge port 141*a*. The fixation shielding plate 147 is then arranged to be in non-contact with rotation shaft 142*a* of the auger screw 142 and the rotation shielding plate 148, and the rotation shielding plate 148 is similarly arranged to be in non-contact with the inner wall of the toner container 140 and the fixation shielding plate 147, therefore, since there is no contact point in the toner flowing-out preventing valve 143, it is possible to prevent the toner from aggregating to be fused by frictional heat.

Note that, although the image forming apparatus 1 of the embodiment is a full-color image forming apparatus, it may be an image forming apparatus exclusively used for monochrome. Moreover, the full-color image forming system is not limited to the tandem type as illustrated, and may be performed by another type. Further, as the developing device, an example of using the two-component developer is shown, however, a developing device of a developing system with a non-magnetic one component developer etc., may be usable.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner cartridge comprising:

a container for containing toner, having an opening for discharging the contained toner;

a toner discharge section provided through a communicating part at a side part of the container where the opening is provided, having a discharge port for discharging toner;

an auger screw provided with a rotation shaft and a spiral blade and rotatably supported in the container, for conveying toner in the container from the opening to the toner discharge section; and a toner flowing-out preventing valve provided in the communicating part, for preventing flowing out of the toner from the opening to the toner discharge section, the toner flowing-out preventing valve being configured so as to open and close the communicating part in conjunction with rotation of the auger screw, the toner flowing-out preventing valve having a fixation shielding plate fixed to an inner wall of the toner discharge section and having an opening, and a rotation shielding plate fixed to the rotation shaft of the auger screw and opening and closing the opening, the fixation shielding plate being arranged to be in non-contact with the rotation shaft and the rotation shielding plate and to be along a surface vertical to an axial line of the rotation shaft of the auger screw, and the rotation shielding plate being arranged to be in non-contact with an inner wall of the toner discharge section and the shielding plate and to be along the surface vertical to the rotation shaft.

2. The toner cartridge of claim 1, wherein the fixation shielding plate has a plurality of sectorial openings and the rotation shielding plate has a plurality of sectorial shielding pieces which coincide with the opening.

3. The toner cartridge of claim 1, wherein at least one of the fixation shielding plate and the rotation shielding plate is made of a material having flexibility.

4. An image forming apparatus comprising:

a photoreceptor drum on which an electrostatic latent image is to be formed;

a developing device for developing a toner image by supplying toner to the electrostatic latent image formed on the surface of the photoreceptor drum;

the toner cartridge of claim 1, for supplying toner to the developing device;

a transfer device for transferring on a recording medium the toner image developed on the surface of the photoreceptor drum; and a fixing device for fixing the transferred toner image on the recording medium.

* * * * *